US006464555B1

(12) United States Patent
Paduano

(10) Patent No.: US 6,464,555 B1
(45) Date of Patent: Oct. 15, 2002

(54) MOBILES

(76) Inventor: Wendy Paduano, 8119 Davmar La., Fredricksburg, VA (US) 22407

( * ) Notice: Subject to any disclaimer, the term of this patent is extended or adjusted under 35 U.S.C. 154(b) by 0 days.

(21) Appl. No.: 09/475,350

(22) Filed: Apr. 4, 2000

(51) Int. Cl.[7] ..... A63H 33/00
(52) U.S. Cl. ..... 446/227; 446/228
(58) Field of Search ..... 446/227, 228, 446/246, 242; 40/617; 403/171, 217

(56) References Cited

U.S. PATENT DOCUMENTS 3,919,795 A * 11/1975 Van Horne Jinivisian et al. ..... 40/33
4,640,034 A * 2/1987 Zisholtz ..... 40/455
4,984,380 A * 1/1991 Anderson ..... 40/455
5,352,145 A * 10/1994 Raiffe et al. ..... 446/227
5,620,274 A * 4/1997 Wear ..... 403/171
5,626,434 A * 5/1997 Cook ..... 403/176
5,672,088 A * 9/1997 Chininis ..... 446/227
5,797,785 A * 8/1998 Silberstein ..... 446/227

* cited by examiner

*Primary Examiner*—Kien T. Nguyen
(74) *Attorney, Agent, or Firm*—Miller Nash LLP

(57) ABSTRACT

Mobiles which have an articulated array of arms connected to a central hub and artifacts attached to the outer, distal ends of the arms by strap-type fasteners. The hub can be rotated by a battery-powered or a spring-type motor as selected by a user of the mobile. The hub of the mobile is attached to a vertically extending support having a flexible segment by a ball and joint connector. A clamp at the lower end of the support is employed to fix the support to a suitable and available structure.

9 Claims, 7 Drawing Sheets

MOBILES

TECHNICAL FIELD OF THE INVENTION

In one aspect the present invention relates to novel, improved, mobiles.

In a more specific aspect, the present invention relates to motorized models.

In yet another specific aspect, the present invention relates to mobiles with an improved mechanism for supporting arms of the mobile from a center hub.

And, in yet another aspect, the present invention relates to mobiles with a novel mechanism for supporting the device from a selected structure.

BACKGROUND OF THE INVENTION

Various types of mobiles—powered and unpowered—are disclosed in U.S. Pat. No. 3,919,795 to Van Horne; U.S. Pat. No. 4,640,034 to Zisholtz; and U.S. Pat. No. 5,620,274 to Wear.

SUMMARY OF THE INVENTION

It is an object of the present invention to provide mobiles which differ from the mobiles disclosed in the above cited patents in a number of important respects. These include: (1) different, user-selectable types of motors for rotating a hub and an array of arms which are fixed to the hub and have artifacts attached to their outer (distal ends); (2) innovative techniques for connecting the arms to the hub and for attaching the selected artifacts to the arms; (3) a support which is connected to the hub of the mobile by a ball and socket connector; (4) a clamp mechanism for mounting the support to an appropriate and available structure. Another innovative feature of the mobiles disclosed herein is a construction of the support which is flexible and thereby allows the hub of the mobile and those components of the mobile supported from the hub to be shifted to a selected location.

One primary object of the invention has been identified above. Additional objects as well as the significant features and the advantages of the invention will be apparent to the reader from the foregoing, the appended claims, and the ensuing detailed discussion and description of the invention taken in conjunction with the accompanying drawings.

DETAILED DESCRIPTION OF THE INVENTION

Figure 1:
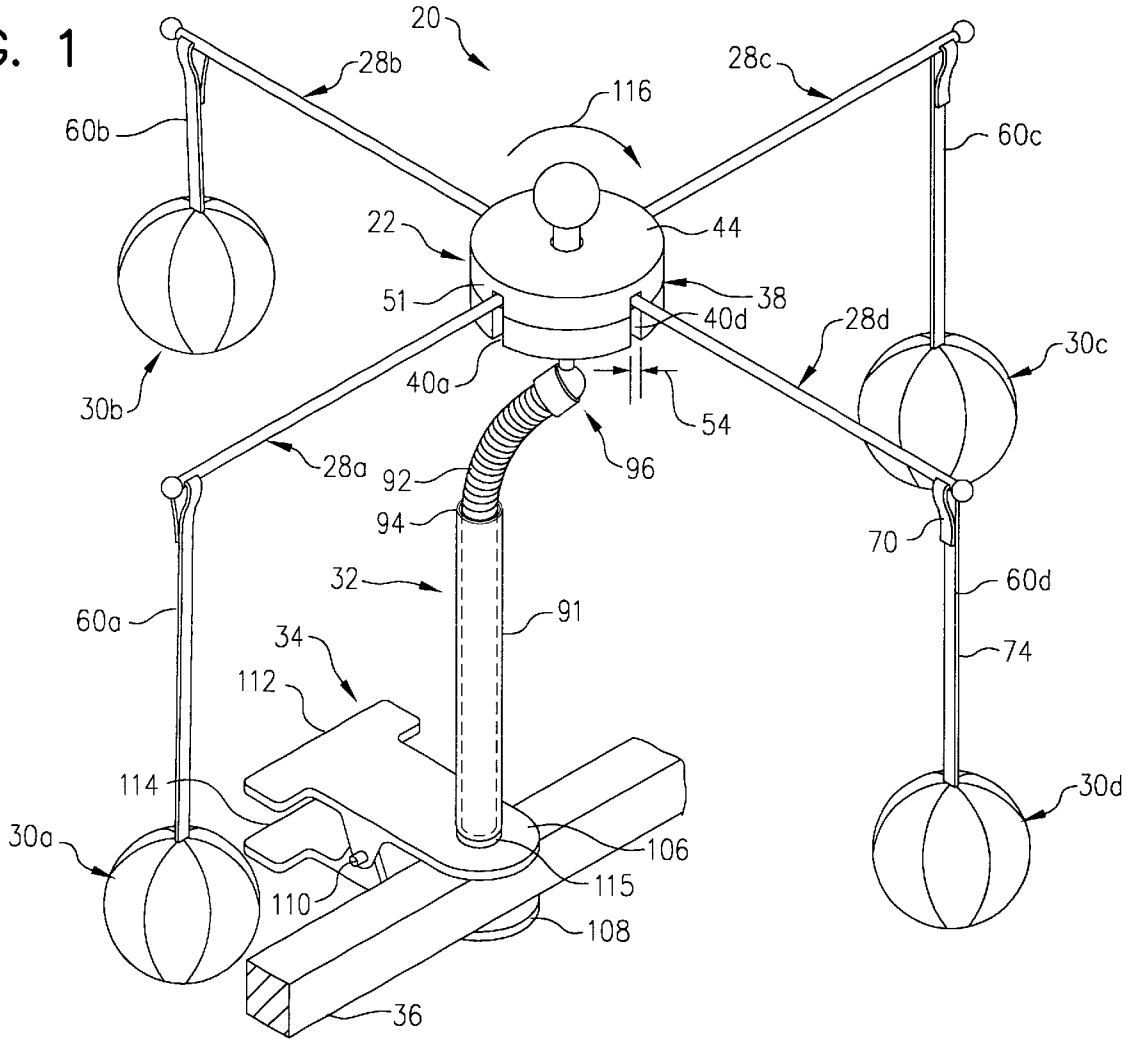
FIG. 1 is a pictorial view of a mobile embodying the principles of the present invention.

Referring now to the drawings, FIG. 1 depicts a mobile 20 constructed in accord with and embodying the principles of the present invention. The main components of mobile 20 are: (1) a hub 22 housing spring driven (FIG. 6) and battery powered (FIG. 7) motors 24 and 26; (2) articulated arms 28*a*–*d* supported at their inner (or proximate) end from hub 22; and (3) artifacts 300*a*–*d* supported from the outer or distal ends of arms 28*a*–*d*. Mobile 20 also includes a vertically extending support 32 and a clamp 34 for supporting hub 22 from a structure such as that illustrated in FIG. 1 and identified by reference character 36.

Figure 2:
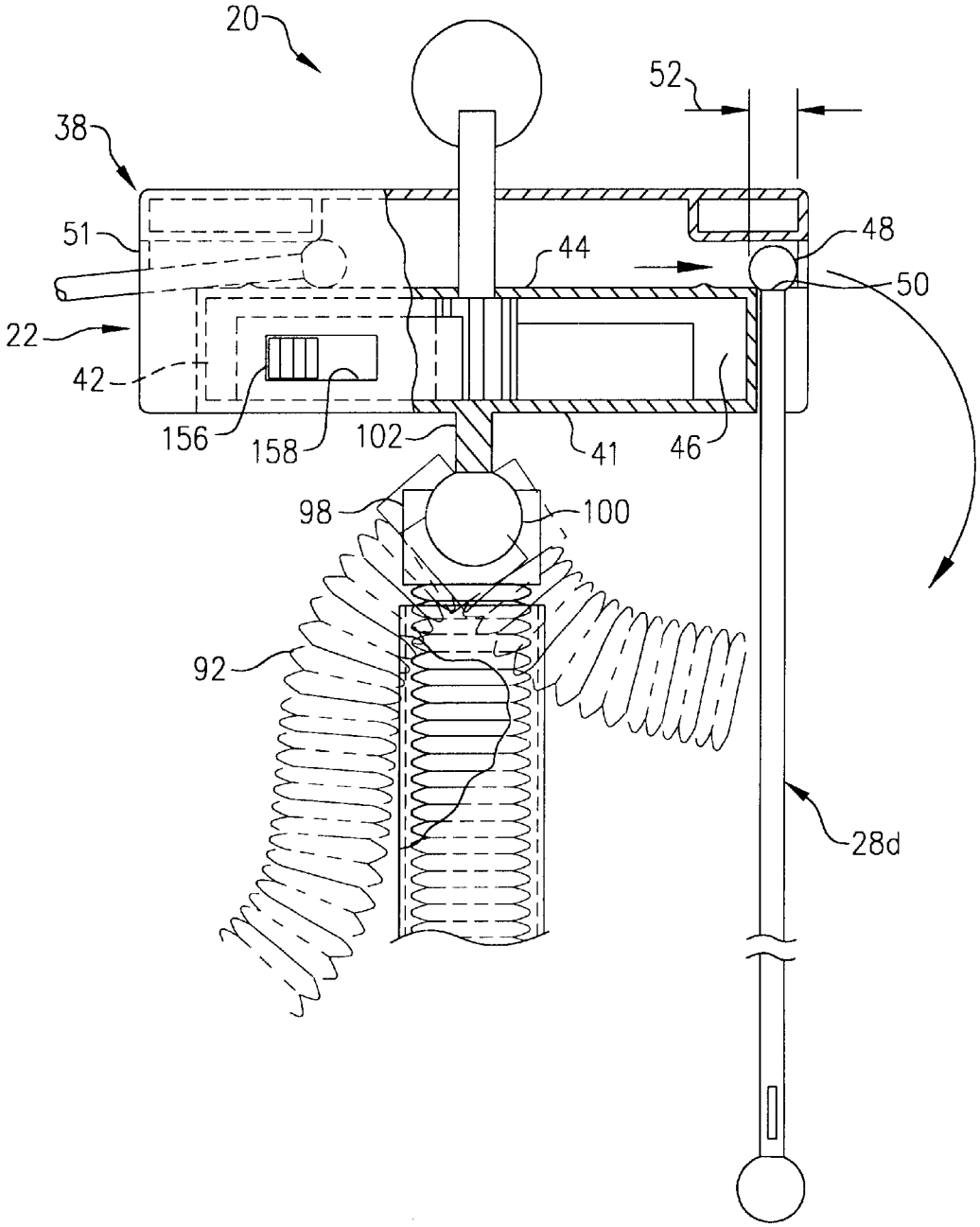
FIG. 2 is a fragmentary view of the FIG. 1 mobile with certain components being broken away to show the internal components of the mobile hub; the components which support the mobile; and one of the mobile arms.

As is best shown in FIGS. 2 and 3, the arms 28*a*–*d* of mobile 20 can be collapsed (see FIG. 2) to facilitate storage of the mobile and extended (see FIG. 1) to their operative positions.

Turning now especially to FIGS. 2 and 3, mobile hub 22 has a casing 38 with slots which extend downwardly through the casing at location corresponding to the four arms 30*a*–*d* of the mobile. Two of these slots are shown in FIGS. 1–3 and identified by reference characters 40*a* and 40*d*.

Also, casing 24 has a bottom wall 41 which cooperates with internal side and top walls 42 and 44 to define a motor/battery compartment 46.

Figure 3A:
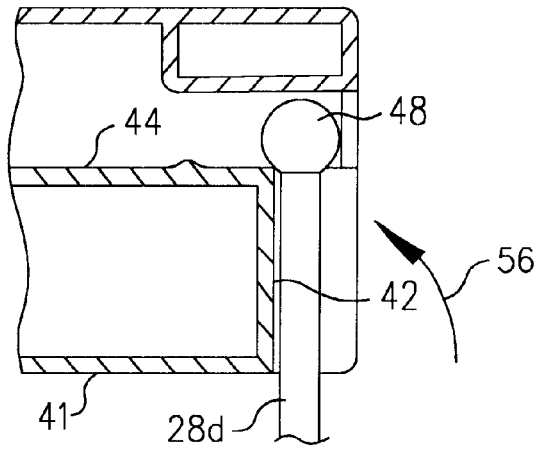
FIGS. 3*a*–3*c* shows a representative one of the arms connected to the hub of the mobile in stowed and active positions and in the process of being moved from the stowed position to the active position.
Figure 3B:
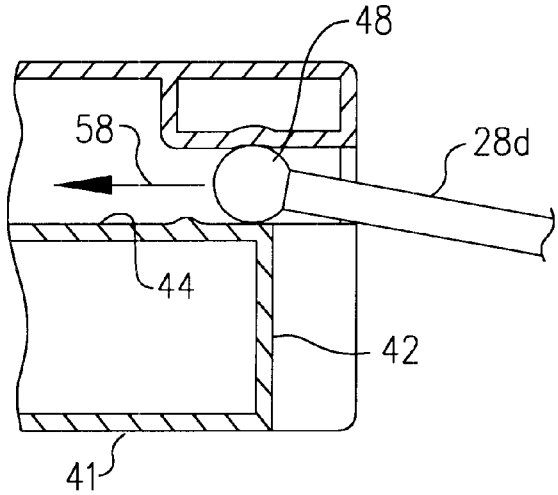

FIGS. 1, 2, and 3*a* show representative mobile arm 28*d* in its collapsed position in which an integral ball 48 at the inner or proximate end 50 of the arm is trapped in casing 24 by: (1) the side wall 42 of motor/battery compartment 46, and (2) the outer side wall 51 of hub casing 38. The distance 52 between the two side walls 42 and 51 is smaller than the diameter of ball 48 as is the width 54 of the slot 40*d* in casing sidewall 48. This keeps arm 28*d* from dropping out of hub 24 when the arm is its collapsed, FIGS. 2 and 3A position.

Figure 3C:
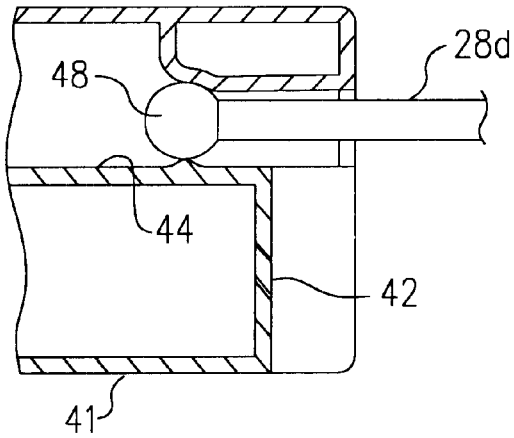

To move arm 28*d* to its operative position shown in FIGS. 1 and 3*c* the arm is first rotated upwardly in slot 40*d* as indicated by arrow 56 in FIG. 3*a*. Next, the arm is displaced inwardly as shown by arrow 58 in FIG. 3*b* until it reaches the position shown in FIG. 3*c* in which the arm is fully extended (see FIG. 1).

Figure 4:
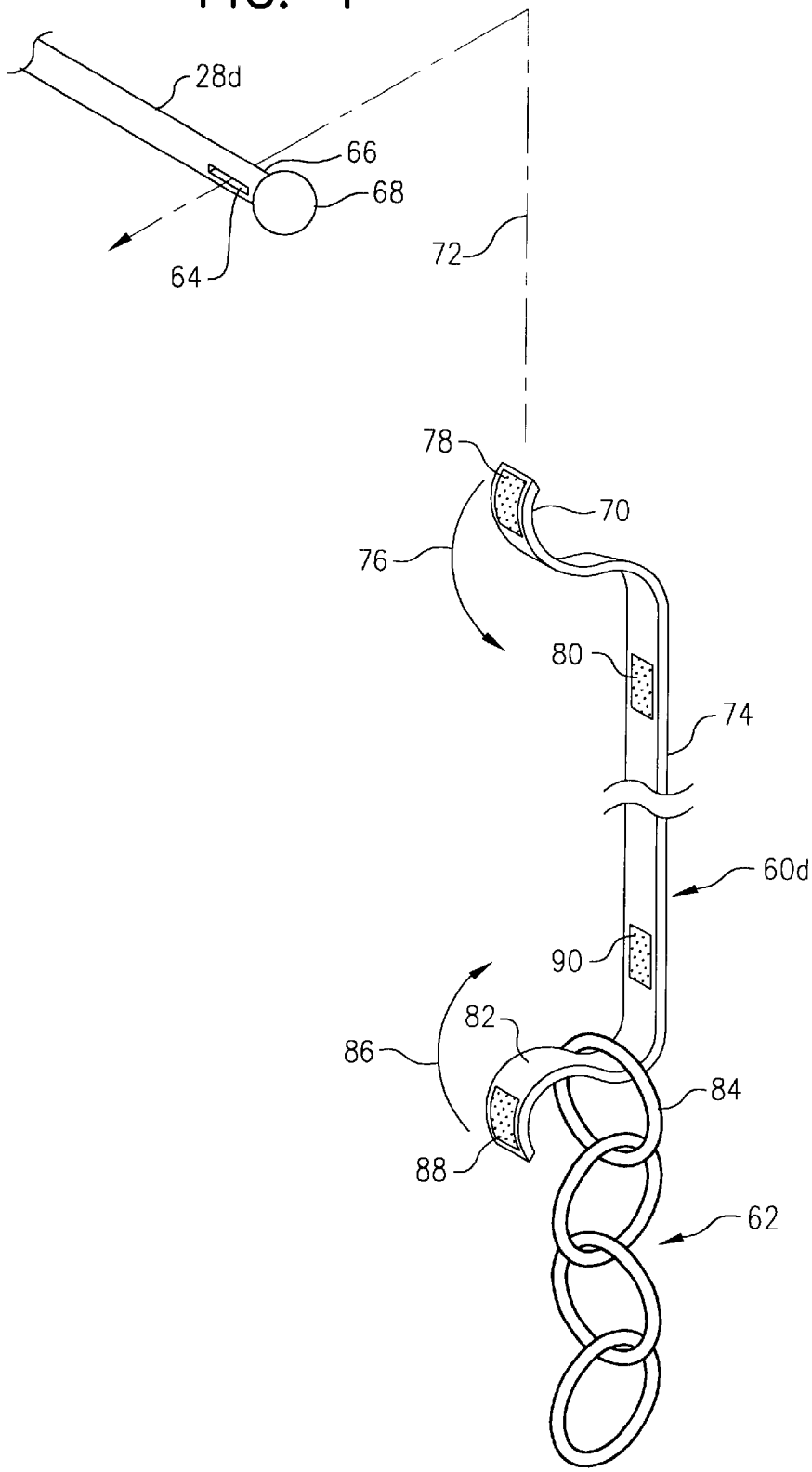
FIG. 4 shows an arrangement embodying the principles of the present invention for attaching dangling or other artifacts to the distal ends of the mobile arms.

Turning now to FIGS. 1 and 4, the artifacts 30*a*–30*d* are attached to the distal ends of arms 28*a*–28*d* by strap type retainers 60*a*–60*d*. The strap 60*d* and one way in which that strap is attached to rod 28*d* are shown in detail in FIG. 4. In this illustrated arrangement, the artifact supported from rod 28*d* by the strap is a series of interlocking rings identified by reference character 62. A slot 64 is formed through the distal end 66 of rod 28*d* to which a knob 68 is attached to eliminate sharp edges and for decorative purposes. The upper end segment 70 of strap 60*d* is extended through slot 64 as shown by arrow 72. Next, end segment 70 is folded against the main segment 74 of the strap as suggested by arrow 76. This engages a VELCRO® patch 78 on end segment 70 with a complementary VELCRO® patch on strap segment 74 to fasten these two segments together as shown in FIG. 1. Next, an integral, lower end segment 82 of strap 60*d* is trained through the upper ring or loop 84 of the set 62 of loops as indicated by arrow 86. This brings a VELCRO® pad 88 on end segment 82 of the strap into contact with a second VELCRO® patch 90 on strap segment 74, fixing the lower end of the loop in place.

In the first-discussed embodiment of the invention shown in FIG. 1, the second step involving strap segment 82 is eliminated as the lower ends of straps 60*a*–60*d* are fixed directly to the associated artifacts 30*a*–30*d*.

Turning now to FIGS. 1 and 2, it pointed out above that mobile hub 22 and the arms 28*a*–28*d* and artifacts 30*a*–30*d* attached to the hub are supported from a structure 36 (which might be a cuibrais) by a support component 32. This support component has a lower, vertically extending, tubular component 91; a flexible element 92 extending upwardly from component 90; and a ball and socket joint 96. This joint is composed of a socket 98 fixed to the upper end 94 of flexible segment 92 and a ball 100 fixed to an integral fitting 102 protruding from the bottom wall 41 of hub casing 38.

Figure 6:
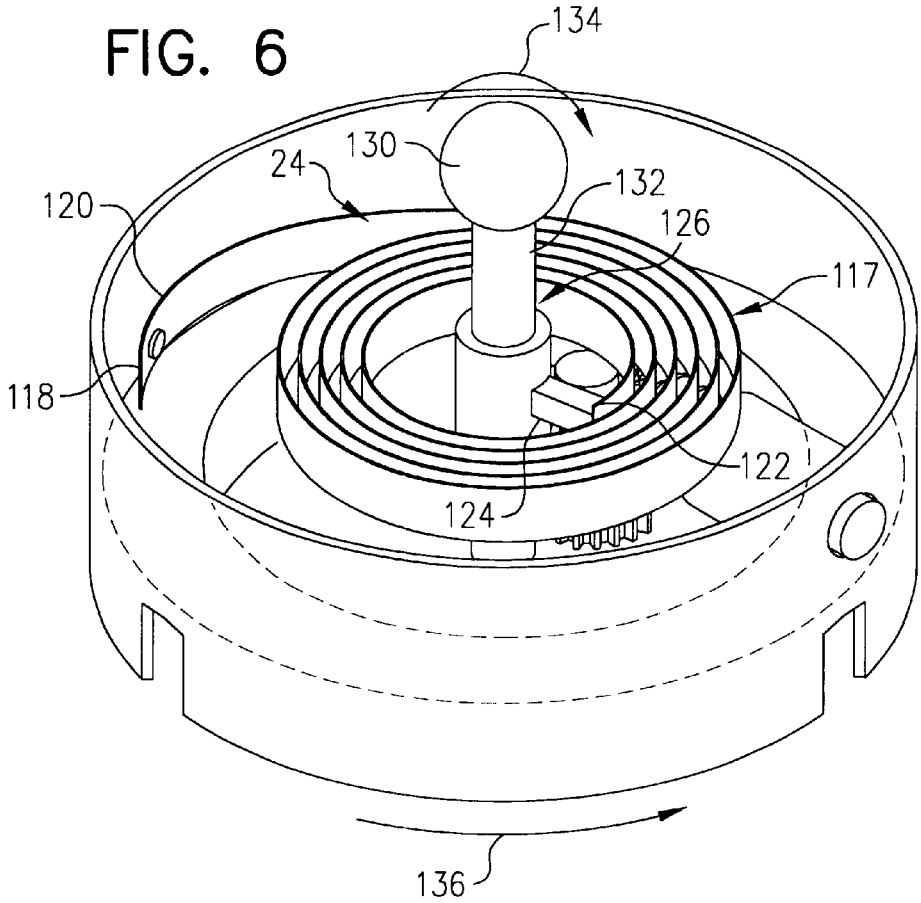
FIG. 6 is a perspective of the mobile hub with part of the hub casing removed to show a spring motor housed in the hub.
Figure 7:
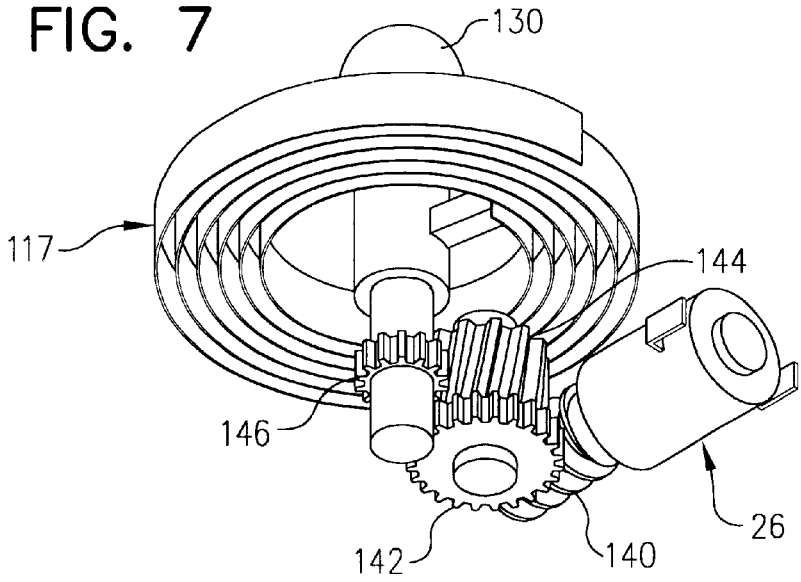
FIG. 7 is a perspective view of the spring and battery motors and associated drive components.

Referring now primarily to FIGS. 2, 6, and 7, the arms 28*a*–28*d* of mobile 20 can be rotated as indicated by arrow 111 in FIG. 1 by either spring motor 24 (FIG. 6) or battery powered electric motor 26 (FIG. 7).

The flexible segment 92 of support 32, together with ball and socket joint 96, allows the mobile to be displaced laterally and then tilted until it is level.

The clamp 34 by which mobile 20 is mounted to a structure 36 is of conventional construction. It includes upper and lower jaws 106 and 108 fixed together by a pivot pin 110 and a spring (not shown) for biasing jaws 106 and 108 toward each other. Jaws 106 and 108 are opened by pressing towards each other the handles 112 and 114 integral with jaws 106 and 108. This allows the jaws to embrace structure 36. Also, as shown in FIG. 1, the lower end 115 of the tubular support component 90 is fixed to upper clamp jaw 106, providing supporting structure from member 36 through the clamp and vertical support to the hub 22, rotating arms 28*a*–28*d*, and artifacts 30*a*–30*d* of mobile 20.

Spring motor 24, housed in motor/battery compartment 46, is of conventional construction. It includes a spiral spring 117 having an outer end 118 fixed, by rivet 120, to the internal side wall 42 of mobile hub casing 38. The inner end 122 of the spring is fixed to an attachment 124 protruding from an actuator 126. The actuator mounted in the hub casing 38 for movement between upper (spring motor engaged) and lower (electric motor engaged) positions.

The spring 117 is wound by rotating a knob 130 at the upper end of actuator shaft 132 in the direction indicated by arrow 134 in FIG. 6. As the spring unwinds, it the spring rotates hub 22 and the components coupled to that hub in the counterclockwise direction indicated by arrow 136.

Figure 8:
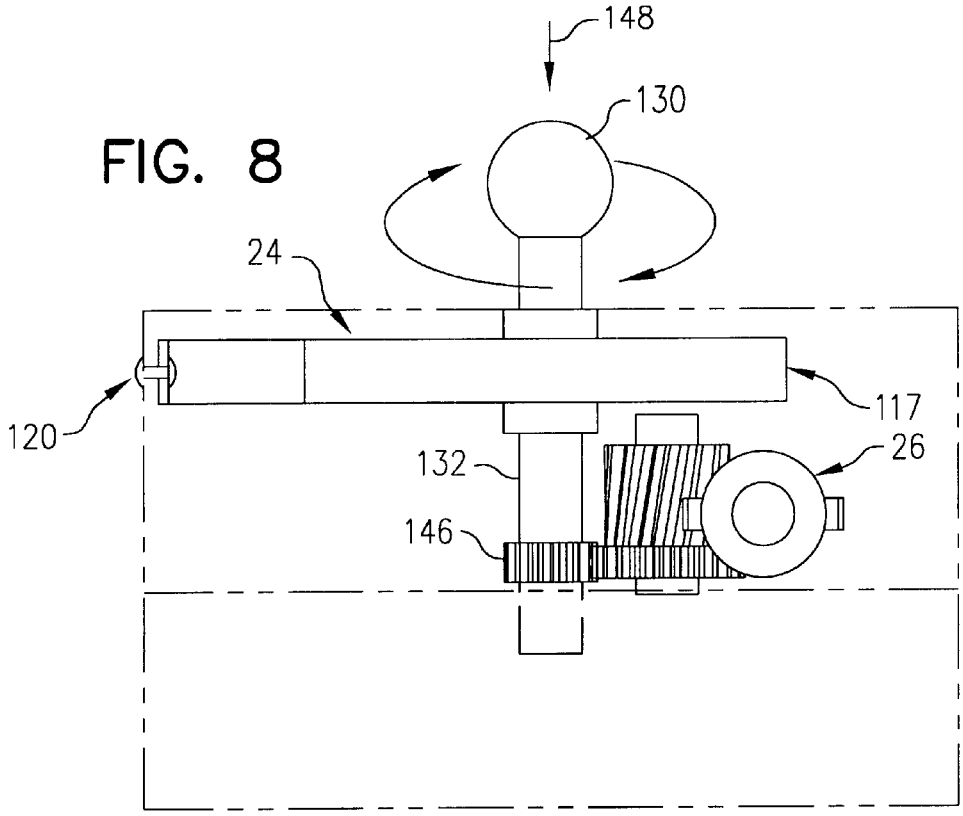
FIG. 8 is a side view showing an actuator displaced to a position in which the battery-powered motor is selected to rotate the arms of the mobile.

Turning now primarily to FIGS. 7 and 8, the battery-operated electrical motor 26 is mounted in hub casing 38 below spring motor 24. The output shaft (not shown) of this motor can be coupled to actuator shaft 136 to rotate hub 22 and arms 28*a*–28*d* by a worm gear 140, a spur gear 142, a spiral gear 144, and a second spur gear 146. Gear 146 is engaged with spiral gear 144 to rotate hub 22 and arm 28*a*–28*d* by depressing actuator 126 as indicated by arrow 148 in FIG. 8. This movement of the actuator also disconnects the actuator from spring motor 24. When the actuator is moved upwardly as indicated by arrow 150 in FIG. 7, the electric motor 26 is disengaged and the spring motor engaged.

Referring now to FIG. 2, motor 26 is turned on and off with a slide switch of conventional character mounted in battery compartment 46. The actuator 156 of the switch is accessible through an opening 158 in the outer side wall 51 of the hub casing.

Figure 5:
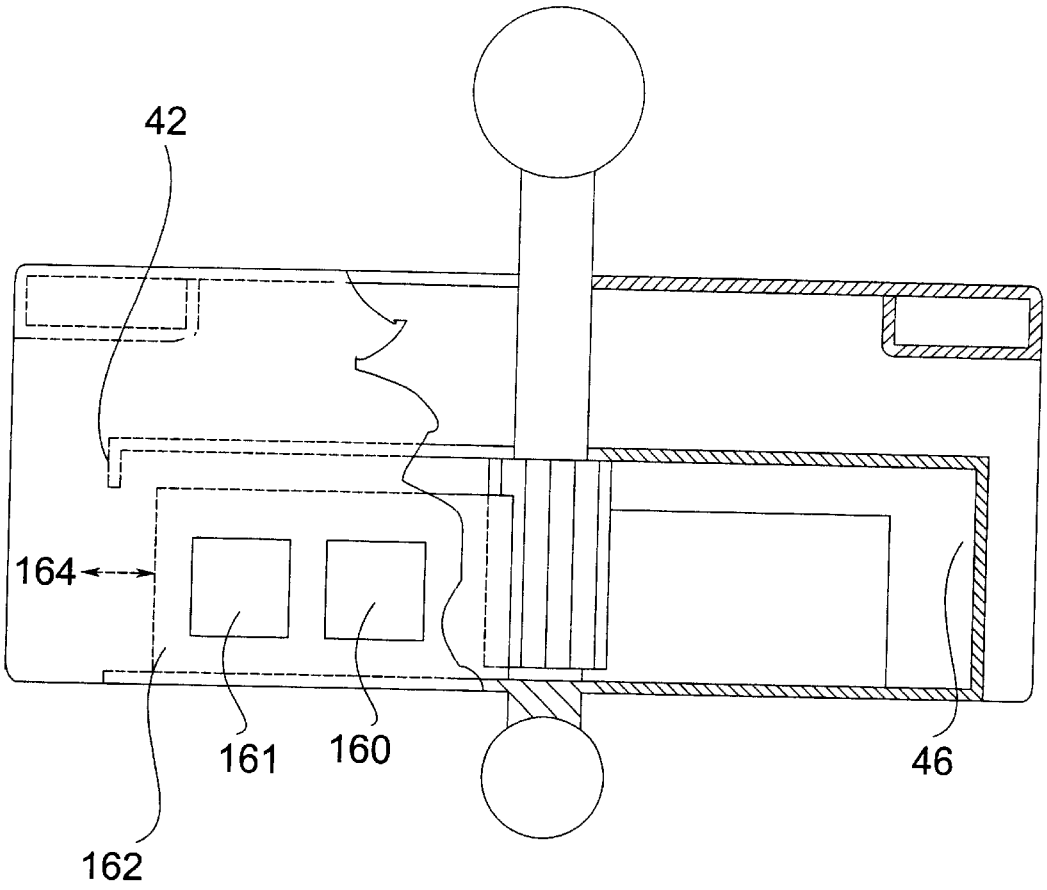
FIG. 5 shows how batteries are loaded into the hub of the mobile to power an electric motor housed in that hub.

Turning next to FIG. 5, batteries 160 and 161 for operating electric motor 26 are installed in battery compartment 46 and, more specifically, in a tray 162. This tray can be moved in and out of the battery compartment through an opening 164 in battery compartment sidewall 42 as indicated by the double headed arrow 164 in FIG. 5.

The terms and expressions that have been employed in the foregoing specification are used as terms of description, not of limitation, and are not intended to exclude equivalents of the features shown and described or portions of them. The scope of the invention is defined and limited only by the claims that follow.

What is claimed is:

1. A mobile comprising:

(a) an array of mobile arms;

(b) at least one artifact supported at a distal end of each arm of said array of mobile arms;

(c) a hub;

(d) at least one coupling mechanism at a proximate end of each arm at said array of mobile arms for coupling said arms to said hub;

(e) a drive mechanism for rotating said hub and said array of mobile arms connected to said hub;

(f) a mount comprising a vertically extending support having an upper end and a lower end;

(g) said vertically extending support fixed at said upper end to said hub;

(h) said vertically extending support having a flexible segment that can be flexed to place said hub in a selected location; and (i) said flexible segment being fabricated from flexible tubing.

2. The mobile of claim 1 further comprising a clamp for attaching said vertically extending support to an available structure, said clamp being attached to said lower end of said vertically extending support.

3. The mobile of claim 1 wherein said upper end of said vertically extending support is fixed to said hub of said mobile by a ball and joint connection.

4. The mobile of claim 1 wherein said at least one artifact is supported by a strap, said strap having an upper and lower end segment, said upper end segment being trained through an opening of said associated mobile arm, and a fastener, said fastener securing said upper and lower end segments together.

5. The mobile of claim 4, said fastener comprising complementary VELCRO® elements at said upper and lower end segments of said strap.

6. The mobile of claim 1, said drive mechanism comprising:

(a) multiple motors, each motor capable of rotating said hub and said array of mobile arms; and (b) a user actuatable control for activating a user-selected one of said motors.

7. The mobile of claim 6 wherein said multiple motors are battery-powered electrical motors.

8. The mobile of claim 6 wherein said multiple motors are spring motors.

9. The mobile of claim 6 wherein said multiple motors are battery-powered electrical motors and spring motors.

* * * * *